US006965203B2

(12) United States Patent
Changaris et al.

(10) Patent No.: US 6,965,203 B2
(45) Date of Patent: Nov. 15, 2005

(54) METHOD AND CIRCUIT FOR REPETITIVELY FIRING A FLASH LAMP OR THE LIKE

(75) Inventors: David G. Changaris, Louisville, KY (US); Wayne S. Zinner, New Albany, IN (US)

(73) Assignee: Synaptic Tan, Inc., Louisville, KY (US)

( * ) Notice: Subject to any disclaimer, the term of this patent is extended or adjusted under 35 U.S.C. 154(b) by 44 days.

(21) Appl. No.: 10/665,173

(22) Filed: Sep. 17, 2003

(65) Prior Publication Data

US 2005/0057180 A1 Mar. 17, 2005

(51) Int. Cl.[7] ..... H05B 37/02; G08B 5/00

(52) U.S. Cl. ..... 315/200 A; 315/224; 315/241 S; 315/130; 315/312; 315/241 R; 340/293; 340/330; 340/326; 340/908

(58) Field of Search ..... 315/312, 130, 315/241 S, 200 A, 241 R, 224; 340/286.05, 286.11, 326, 330–333, 293, 908

(56) References Cited

U.S. PATENT DOCUMENTS 4,967,177 A * 10/1990 Nguyen ..... 340/326
5,128,591 A * 7/1992 Bocan ..... 315/241 S
5,191,261 A 3/1993 Mass
5,594,308 A 1/1997 Nuckolls et al.
5,886,620 A * 3/1999 Stewart et al. ..... 340/332
6,330,258 B1 12/2001 Kawamura
6,529,391 B2 3/2003 Yoshinaga et al.

* cited by examiner

*Primary Examiner*—Don Wong
*Assistant Examiner*—Chuc Tran
(74) *Attorney, Agent, or Firm*—Middleton Reutlinger

(57) ABSTRACT

Disclosed is a method and circuit for repetitively firing a flash lamp. The method utilizes a power supply having a periodic voltage signal. The method times the discharge of the flash lamp to occur when the power supply signal is below the flash lamp self extinguishing voltage such that the flash lamp de-ionizes while the power supply signal remains below the self extinguishing voltage, thus preventing afterglow. The circuit utilizes a means for detecting when the voltage of the power supply voltage signal falls below the self extinguishing voltage to trigger the flash lamp. An additional embodiment adds a means for interrupting current flow in the flash lamp before the voltage across a storage capacitor falls below said self extinguishing voltage. The method and circuit may be extrapolated for use with other electromechanical devices.

13 Claims, 8 Drawing Sheets

METHOD AND CIRCUIT FOR REPETITIVELY FIRING A FLASH LAMP OR THE LIKE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENTIAL LISTING," A TABLE, OR A COMPUTER PROGRAM LISTING APPENDIX SUBMITTED ON A COMPACT DISC

Not applicable.

BACKGROUND OF THE INVENTION

1. Field of the Invention

The present invention relates to electrical circuits for repetitively firing a flash lamp or the like.

2. Description of Prior Art

Arc lamps generally have a pair of electrodes between which an arc can be created by applying a voltage potential between the electrodes which is greater than the breakdown voltage of the medium between the electrodes.

Flash lamps generally have a pair of electrodes sealed in a tube containing a gaseous medium which is normally non-conductive, but which can be externally ionized to become conductive. The electrodes are connected to an energy storage device, such as a capacitor, which can be charged to a high energy level. The gaseous medium may be ionized and, thus, become conductive, by briefly applying a high voltage to a trigger wire wrapped around the lamp. Thus, the energy stored in the capacitor will discharge through the flash lamp as a high current density arc which creates a pulse of high energy electromagnetic radiation, such as visible light or ultraviolet radiation.

The gaseous medium will remain conductive as long as current continues to flow, even after the voltage is removed from the trigger wire. However, the current will cease flowing when the voltage across the electrodes falls to a level defined for this description as the "self extinguishing voltage" or "discharge resting potential" of the flash lamp. Typical self extinguishing voltage values fall in the 100–300 volt range. Shortly after the current stops flowing, the gaseous medium will de-ionize and become non-conductive again.

Additionally, for the purposes of this description, the period of time for the firing of the flash lamp from the ionization to the de-ionization of the gaseous medium is defined as the "discharge time". Typical discharge times will fall in the 30–200 microsecond range.

Pulsed radiation has been found to be useful in tanning, treating human skin diseases, curing plastics, and photochemical processes, among other uses. Thus, it is desirable to repetitively "fire" flash lamps to generate such pulsed radiation.

However, the gaseous medium of the flash lamp must de-ionize before the capacitor can be recharged for another cycle. If the flash lamp fails to de-ionize before charging voltage greater than the self extinguishing voltage is applied to the capacitor, the lamp will not de-ionize and current will continue to flow through the lamp producing "afterglow" or continuous current flow through the gas. Afterglow results in large continuous current flows resulting in rapid overheating and system failure.

In the past, pulsed operation of a flash lamp required a separate circuit for holding the charging voltage from the capacitor until the gas was fully de-ionized in each flash cycle. As the flash energy and cycle frequencies increase, electromagnetic interference and timing issues cause the complexity and expense of such separate circuits to also increase.

BRIEF SUMMARY OF THE INVENTION

It is an object of the present invention to provide a simple method and circuit for repetitive firing of the flash lamp or the like.

While the disclosed invention is directed primarily to flash lamps, one of skill in the art will recognize that the invention may be applied to other electrical devices by controlling the discharge and recharge timing of the energy storage device to deliver similar pulses of high current density energy.

These and other objects are achieved through a method and circuit for repetitively firing a flash lamp.

The method has the steps of providing a periodic power supply signal having a minimum voltage below the flash lamp de-ionizing voltage threshold, providing a means for storing energy, such as an energy storage circuit, across the electrodes of the flash lamp and across the power supply, charging the energy storage means to the peak voltage of the power supply signal, firing the flash lamp when the power supply signal is below the de-ionizing voltage threshold, and repeating the charging and firing steps repeatedly.

The circuit has a means for storing energy, such as an energy storage circuit, having inputs for connection to a periodic power supply signal and connected across the electrodes of the flash lamp, a means for triggering the flash lamp, such as a triggering circuit, and a means for detection when the voltage of the periodic power supply signal falls below a predetermined level, such as a voltage detection circuit, where the means for detecting is operative to trigger the means for triggering, thereby firing the flash lamp when the periodic power supply voltage signal is below the predetermined level.

Alternate embodiments of the method and circuit add a means for interrupting or quenching the current flow, such as a current interruption circuit, to the flash lamp when the voltage across the energy storage means fall to a predetermined level.

Finally, the principles of the invention may be extrapolated to other electrical devices by controlling the discharge and recharge timing of the energy storage device to deliver similar pulses of high current density energy.

DETAILED DESCRIPTION OF THE INVENTION a. First Embodiment

Figure 1:
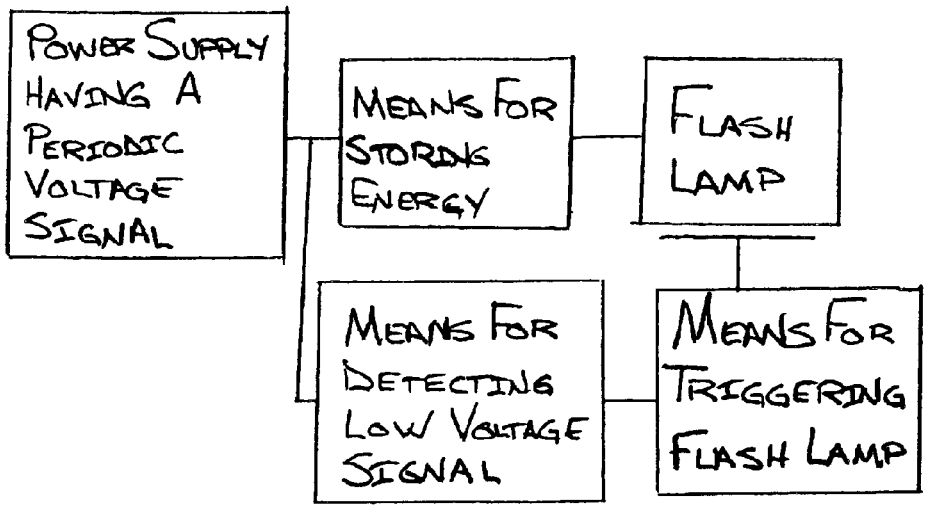
FIG. 1 show a block diagram of a method and circuit for repetitively firing a flash lamp according to the present invention.

FIG. 1 is a block diagram of a first embodiment of the present invention having a power supply having a periodic voltage signal, a means for storing energy, such as an energy storage circuit, attached to the power supply, a flash lamp attached to the energy storage means, a means for detecting a low voltage signal, such as a voltage detection circuit, which samples the power supply signal, and a means for triggering the flash lamp, such as a flash lamp triggering circuit, which is responsive to the low voltage detection means to trigger the flash lamp.

Figure 2:
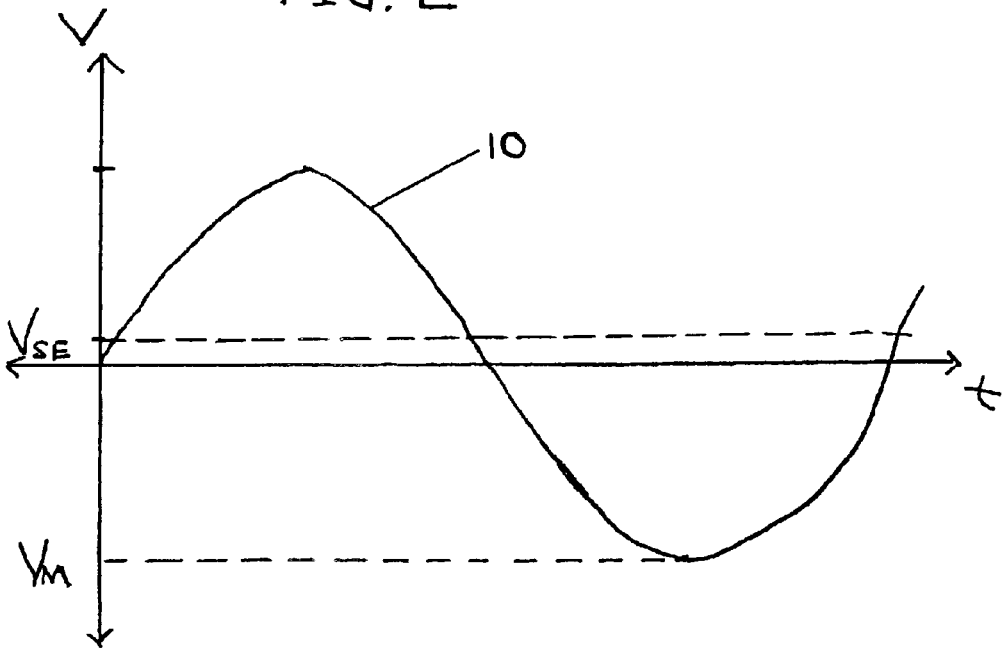
FIG. 2 shows a representative periodic power supply signal as might be used with the present invention.

FIG. 2 shows a sample periodic voltage signal 10 of a power supply. The voltage signal 10 has a minimum voltage $V_M$. Also marked is a sample flash lamp self extinguishing voltage $V_{SE}$. The minimum voltage $V_M$ of the power supply of the invention must be less than the flash lamp self extinguishing voltage $V_{SE}$.

Additionally, the period of time that the voltage signal 10 is less than the flash lamp self extinguishing voltage $V_{SE}$ must be greater than discharge time of the flash lamp.

Advantageously, the embodiments of the invention described herein may use standard 115 volt or 230 volt, 60 hertz alternating current as the primary power source, provided to the primary side of a transformer, for stepping up the voltage of the signal to approximately 2000 volts for firing the flash lamp. Thus, the period of time that the voltage signal 10 is less than a typical flash lamp self extinguishing voltage of 100–300 volts will be substantially greater than the discharge time of 30–200 microseconds for a typical flash lamp. However, one of skill in the art will recognize that the invention will perform with any periodic signal meeting the requirement that the minimum voltage $V_M$ is less than the self extinguishing voltage $V_{SE}$.

Returning now to FIG. 1, the AC power supply charges the energy storage means. When the means for detecting a low voltage signal detects that the power supply signal 10 is less than the flash lamp self extinguishing voltage $V_{SE}$, it activates the means for triggering the flash lamp, which fires the flash lamp, thereby discharging the energy storage means while the power supply signal 10 remains below the flash lamp self extinguishing voltage $V_{SE}$. Thus, the gaseous medium of the flash lamp will de-ionize prior to the return of the power supply signal 10 and the voltage across the energy storage device to a level above the de-ionizing voltage threshold, preventing afterglow and the problems associated therewith.

Figure 3:
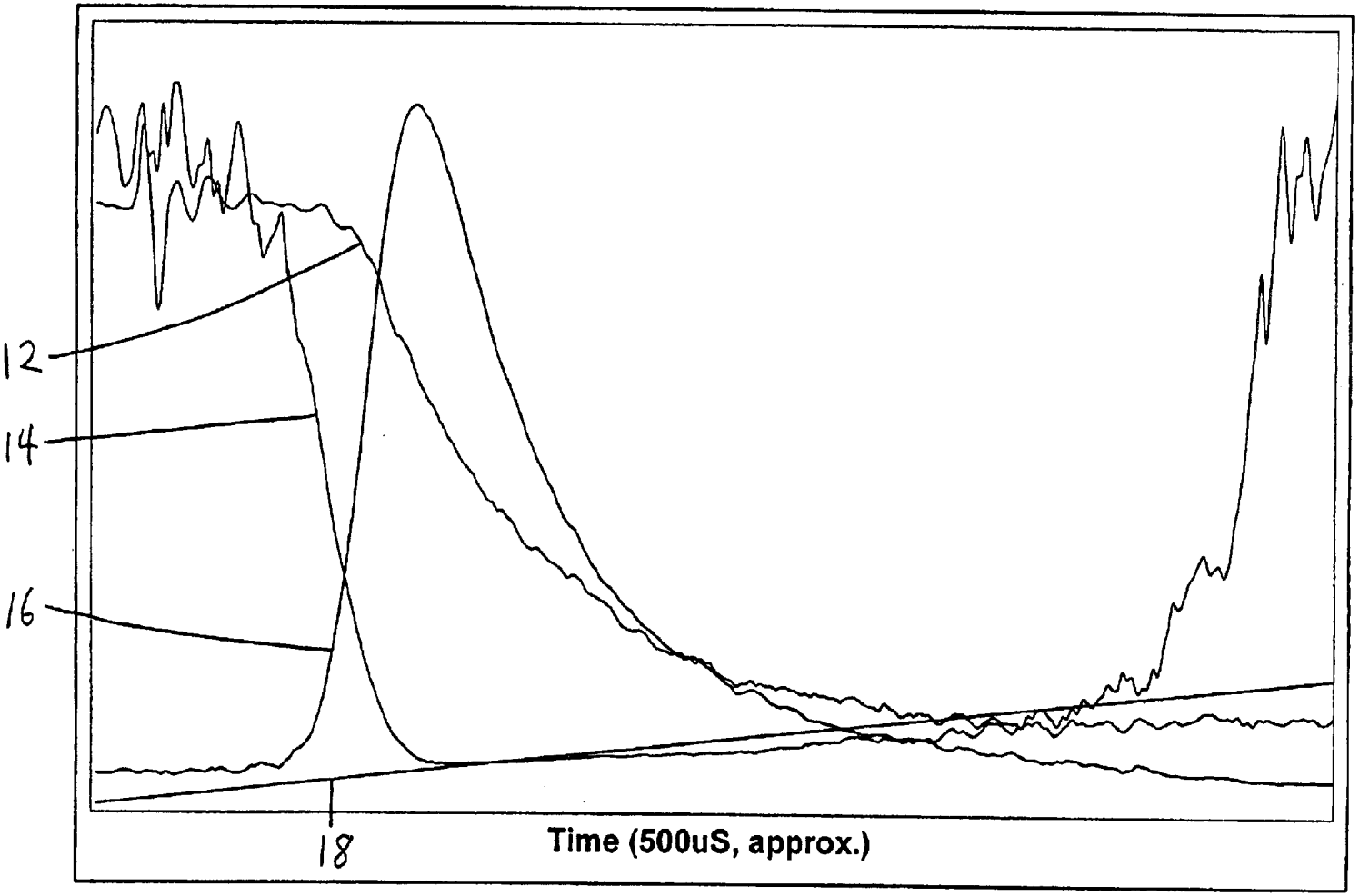
FIG. 3 shows a timing diagram of the electrical events within a flash lamp circuit according to a first embodiment of the present invention.

Thus, FIG. 3 shows the electrical events within a representative flash lamp during a discharge. The voltage 12 across the lamp electrodes peaks at approximately 2000 volts. When the trigger voltage ionizes the lamp, resistance 14 falls close to zero for about 100 microseconds. The current 16 increases to several thousand amperes for a similar time frame. The voltage 12 falls to about 200–300 volts. The power supply voltage signal 18 does not rise above this 200–300 volt discharge level until the lamp has fully de-ionized and returned to full resistance.

Figure 4:
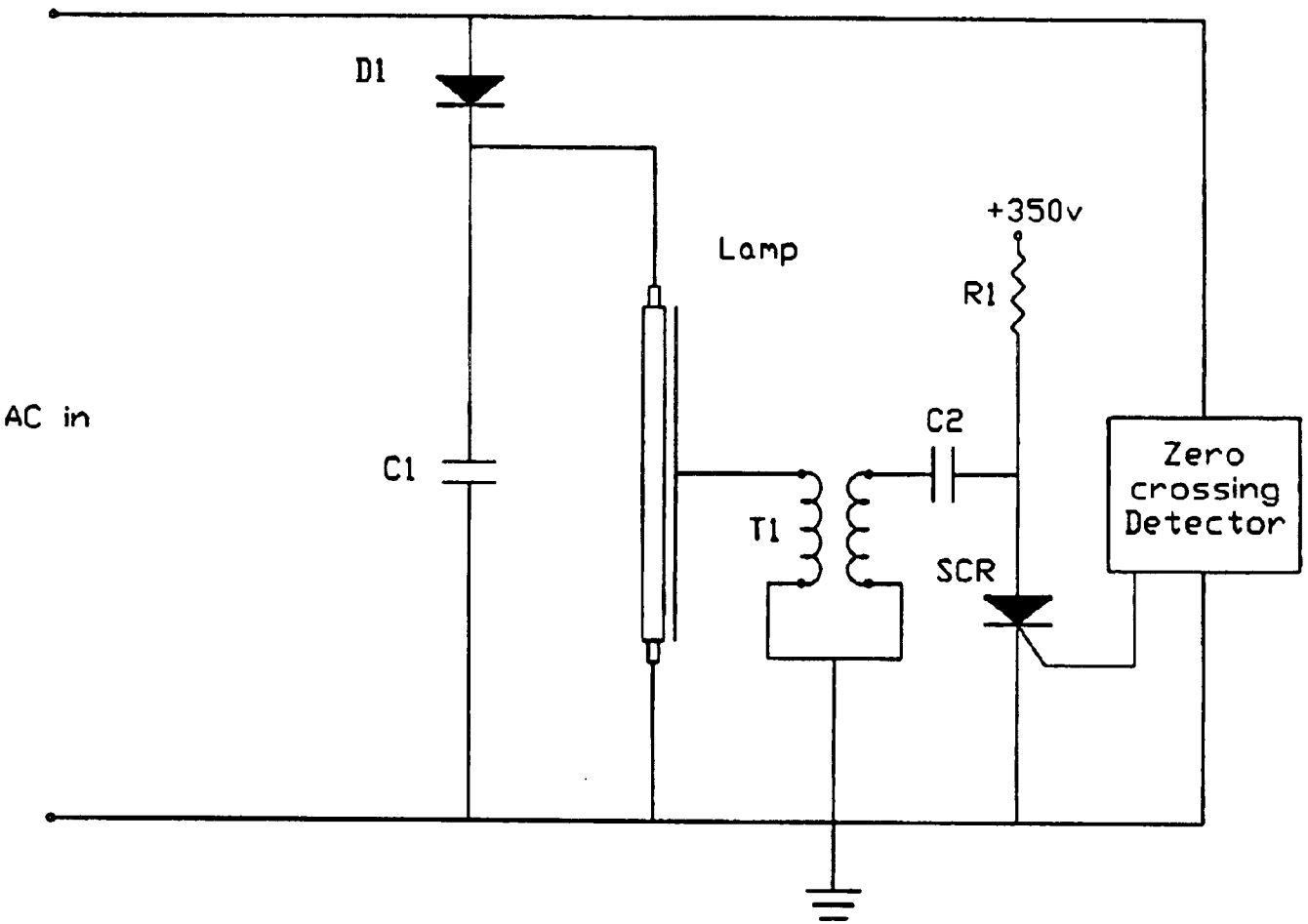
FIG. 4 is an electrical schematic diagram of a flash lamp circuit according to a first embodiment of the present invention.

FIG. 4 shows a representative circuit according to the first embodiment of the present invention wherein the means for storing energy is a capacitor C1. The means for detecting a low voltage signal is a voltage sensing circuit. The means for triggering the flash lamp is shown as the circuit elements SCR, capacitor C2, and trigger coil T1. The flash lamp medium is xenon at less than one atmosphere with a minimum discharging voltage of 1000 volts.

Figure 5:
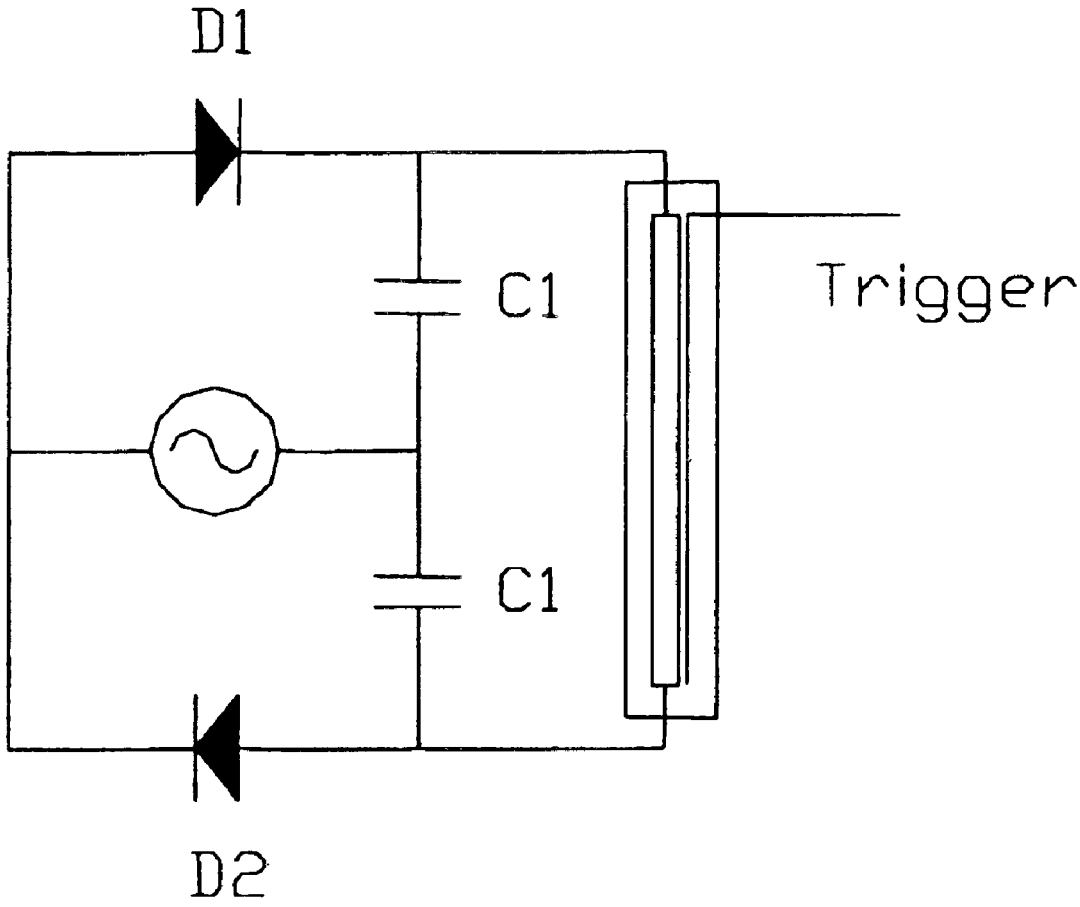
FIG. 5 shows an alternate charging configuration.

FIG. 5 shows an alternate charging arrangement wherein one side of the power supply voltage signal, such as the high power secondary winding of a transformer, is connected to a node between two capacitors, while the other side of the power supply voltage signal is connected a forward biased diode that charges one capacitor to a positive voltage and also to a reverse biased diode that charges the other capacitor to a negative voltage.

A low power secondary winding of the transformer (not shown) can be used to charge a small capacitor C2 for discharge into the trigger coil T1 that ionizes the flash lamp. To operate the linear xenon lamp at an average power of 600 watts, each of 60 flashes per second must receive 10 joules. Using the alternate charging arrangement, the two storage capacitors C1 are charged to positive 1000 volts and negative 1000, respectively, for a total potential across the flash electrodes of 2000 volts. The trigger coil T1 transforms the trigger pulses of 10–15 millijoules from a 0.22-microfarad capacitor C2 to 15,000–25,000 volts to ionize the lamp 60 times per second. The pulse is initiated from the voltage sensing circuit when the power supply voltage signal approaches zero. The threshold of this voltage sensing circuit is adjusted to ensure that the light pulse will extinguish before the power supply voltage signal exceeds the self-extinguishing voltage of the lamp. With the SCR in the off state and the flashlamp de-ionized, the next voltage cycle will recharge the storage capacitors without "afterglow."

b. Second Embodiment

Figure 6:
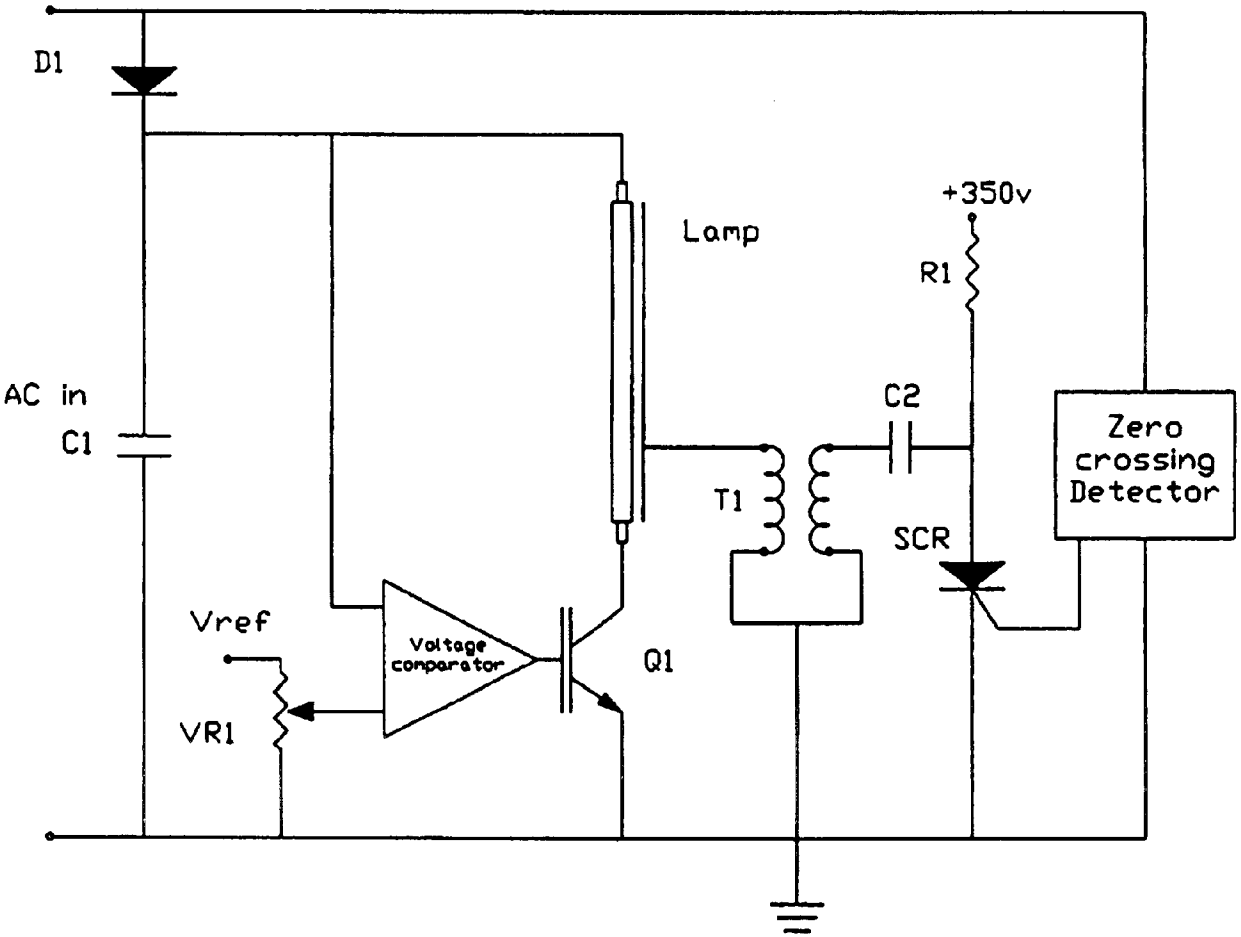
FIG. 6 is an electrical schematic diagram of a flash lamp circuit according to a second embodiment of the present invention.

In a second embodiment, as shown in FIG. 6, additional circuitry in series with the flash lamp is used to interrupt the flash prior to the natural decay of the storage capacitors C1. The interruption is introduced at a specified voltage. The current interruption reduces the current long enough to allow the gas to de-ionize and become highly resistive. This in turn allows the alternating current to re-cycle through recharging the capacitors for a subsequent discharge. This allows the amount of energy released from the storage capacitors C1 to be tightly controlled. Larger capacitors may be charged to a higher energy level, resulting in extended or prolonged peak current densities.

As shown in FIG. 6, the current interruption circuitry of the second embodiment is comprised of a high current bipolar MOSFET operated by a voltage comparator. The set point of the voltage comparator is set by Vref and VR1. The voltage comparator monitors the storage capacitor C1 during the flash and sends a signal to the bipolar MOSFET when the voltage drops below the set point. This signal turns off the MOSFET and interrupts the current flow to the lamp, which forces the lamp to de-ionize well before the storage capacitors C1 have completely discharged.

Figure 7:
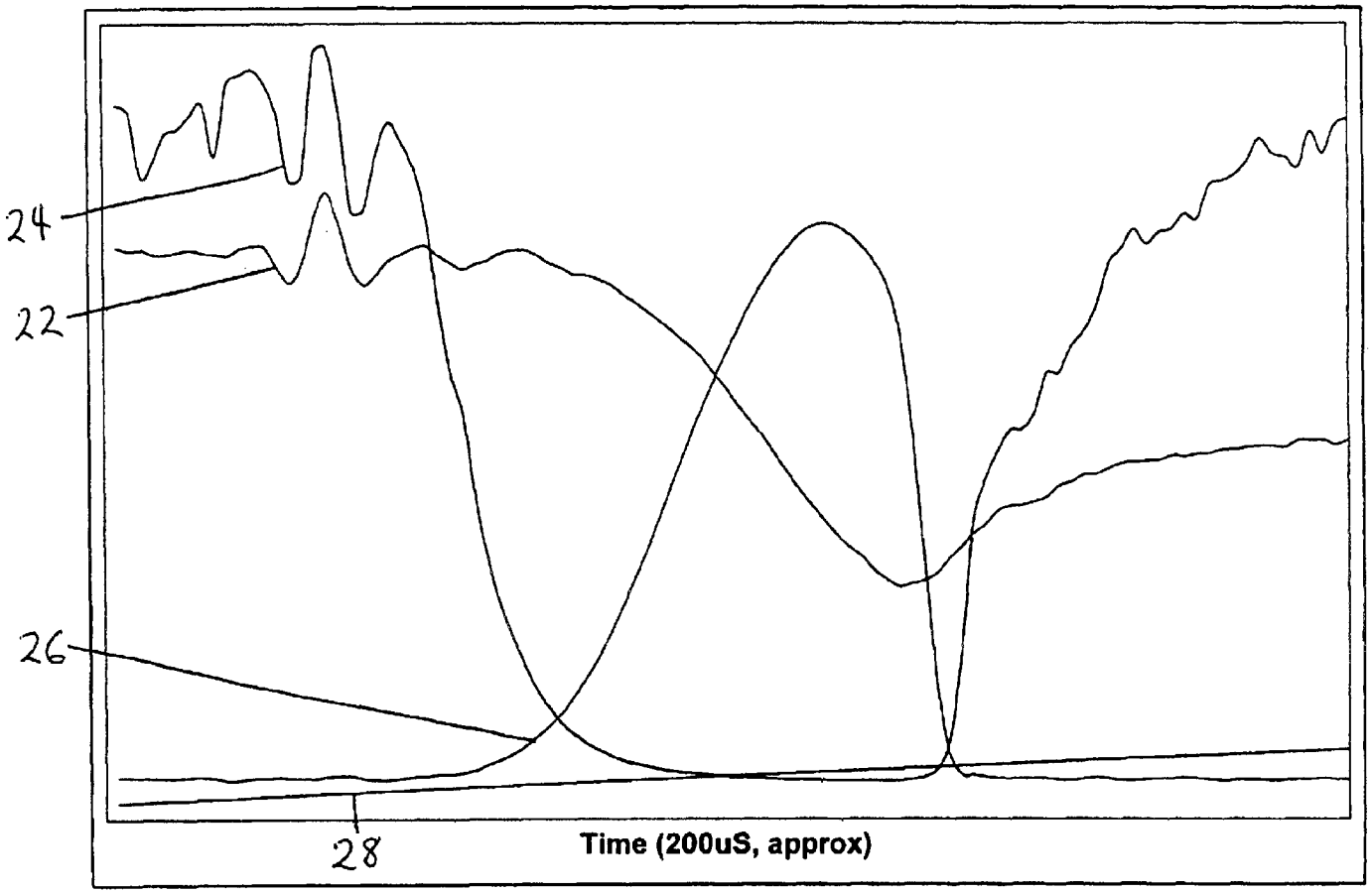
FIG. 7 shows a timing diagram of the electrical events within a flash lamp circuit according to a second embodiment of the present invention.

FIG. 7 shows the electrical events within the flash lamp circuit according to the second embodiment of the invention. The voltage across the lamp 22 peaks at approximately 2250 volts. When the trigger voltage ionizes the lamp medium, the lamp resistance 24 falls close to zero for about 50 microseconds. Initially, the current 26 increases to several thousand amperes. The bipolar MOSFET interrupts the current when the voltage drops below the set point, which is about 1500 volts. The power supply voltage signal 28 does not rise above this 1500 volt discharge level until the lamp has fully de-ionize and returned to full resistance.

c. Relationship between Current Density and Spectral Output

Another important perspective is the relationship between current density and spectral output. Typically as current density reaches 7000 amps/cm$^2$ the light emitted becomes more ultraviolet. Superimposed upon this is the electron shell architecture for each as, causing some to have unique and specific responses to subtle changes in the current density. The general formula for energy within a capacitor that can be discharged into a gas lamp states $$\text{Energy}=\tfrac{1}{2}(CV^2)$$

Where C represents capacitance and V represents the charging voltage. This formula represents the situation where the capacitor discharges to the point where the gas plasma extinguishes. The special situation develops when a device is introduced to stop the discharge at a certain voltage. The energy formula becomes $$\text{Energy}=\tfrac{1}{2}C[(V_2)^2-(V_1)^2]$$

When the difference between $V_2$ and $V_1$ remains constant then the difference of the squares increases as the voltages increase. For example the difference between 1 and 0 volts and between 21 and 20 volts remains 1 volt. But the difference of the squares is 41. By increasing the charging voltage $V_2$ and the size of the capacitor C1, the pulse duration may be shortened while also maintaining or increasing the energy. This results in increased current density and shorter pulse duration. The second embodiment of the invention demonstrates this effect.

Figure 8A:
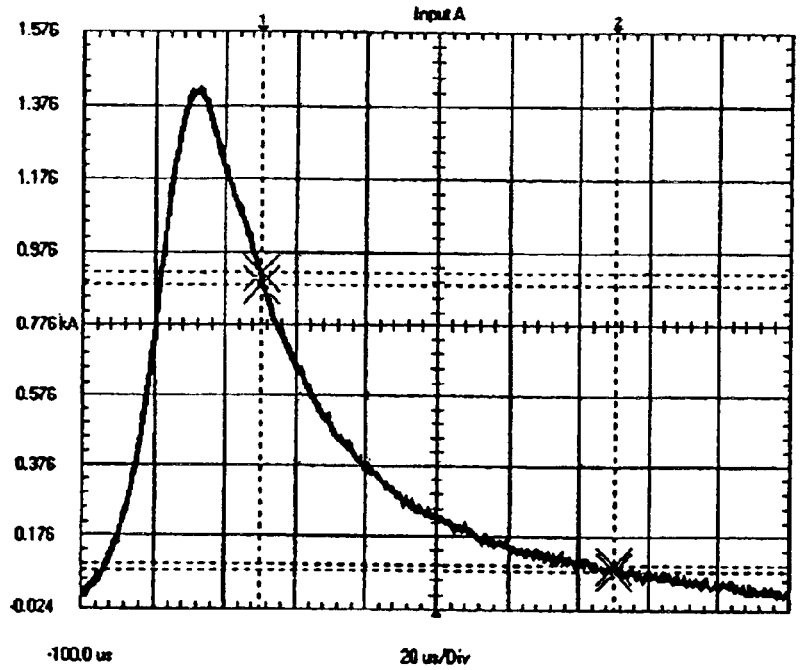
FIG. 8*a* shows a timing diagram of a current flow during discharge of a flash lamp circuit according to a first embodiment of the present invention.
Figure 8B:
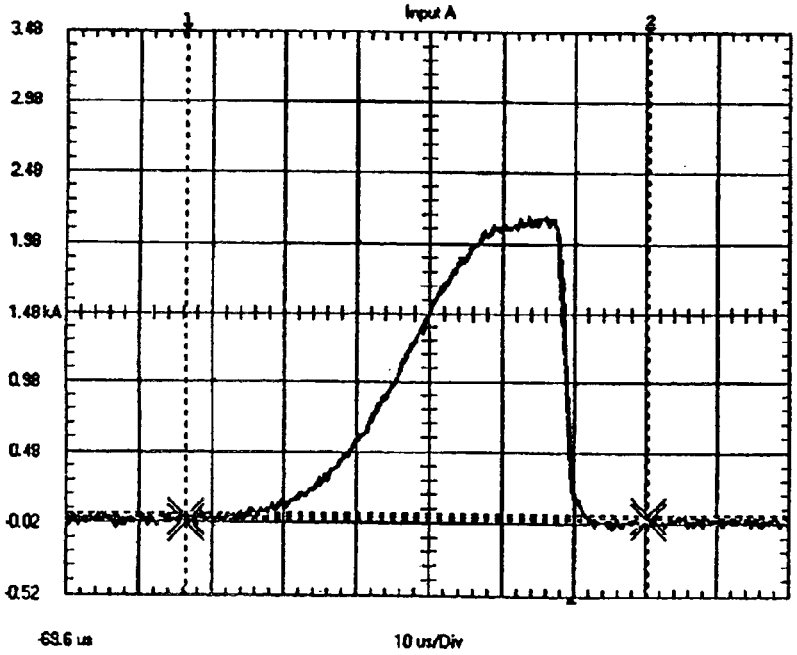
FIG. 8*b* shows a timing diagram of a current flow during discharge of a flash lamp circuit according to a second embodiment of the present invention.

FIGS. 8*a* and 8*b* show representative current flows of embodiment 1 and embodiment 2, respectively. As shown, interrupting the discharge current allows the shape of the current discharge to be molded to increase and prolong the average current density during the light pulse, providing the benefit of targeting the response desired from flash lamp, e.g. specific spectral output.

Figure 9:
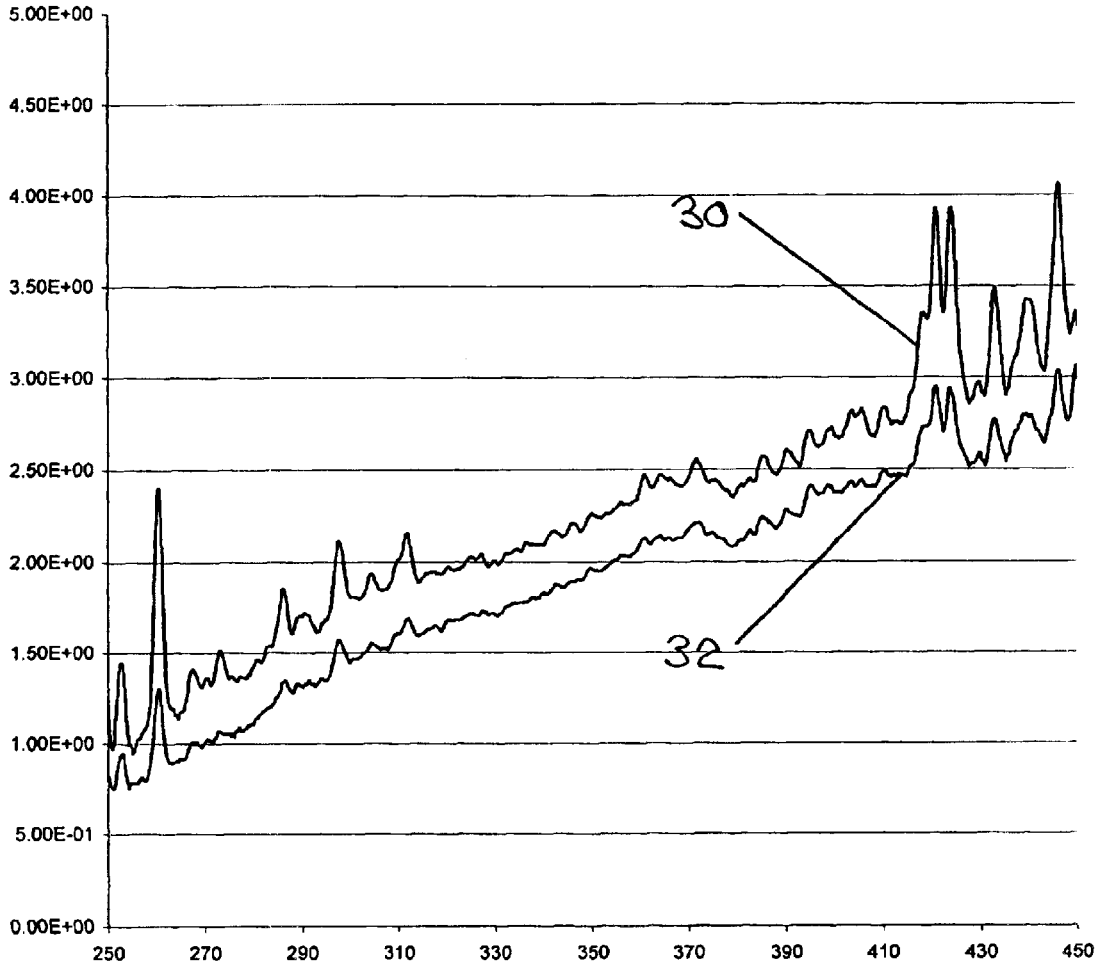
FIG. 9 shows a graph of the spectral output of the flash circuits according to the first and second embodiments of the present invention.

FIG. 9 shows a representative spectral output of the embodiments of the invention. The spectral output of the second embodiment 30 shows an increase in the overall amount of ultraviolet light and selective peaks in this region over the spectral output of the first embodiment 32.

d. Increased Current Density with Other Electrical and Electromechanical Devices Similar increases in current density can be realized with other electrical and electromechanical devices. One example of such a device is a motor. In a motor, the force generated is proportional to the current density of the power supply. A sustained higher current density will transfer energy more efficiently. Thus, multiple timing circuits and capacitors may be utilized to provide smoother current transfer and to generate more efficient electromotive force.

Extrapolating from the flash lamp circuit embodiments, the invention employs a first detection circuit for determining when the power supply voltage signal falls below a first predetermined value, which is selected to provide time for the energy storage means to discharge while the power supply voltage signal is low. Thus, the discharge may be completed before the power supply voltage starts recharging the energy storage means. Additionally, the invention employs an interrupting means to stop the discharge prior to full discharge of the energy storage means. A second detecting circuit is used to sense when the voltage across the energy storage means falls below a second predetermined value. Thus, by controlling the discharge and recharge timing of the energy storage device, the invention will produce pulses of high current density energy.

Multiple circuits may then be synchronized to provide power waveforms required to operate such electromechanical devices at variable speeds or as otherwise desired.

The detail description of the embodiments contained hereinabove shall not be construed as a limitation of the invention, as it will be readily apparent to those skilled in the art that design choices may be made changing the configuration without departing from the spirit or scope of the invention.

We claim:

1. A method of repetitively firing a flash lamp, said flash lamp having a self extinguishing voltage and a discharge time, said method comprising the steps of:

providing a power supply having a periodic voltage signal, said periodic voltage signal having a component where the voltage signal is less than said flash lamp self extinguishing voltage, said signal component being longer than said flash lamp discharge time;

providing a means for storing energy, said energy storage means being connected across the electrodes of said flash lamp and across said power supply;

charging said energy storage means with said power supply voltage signal;

firing said flash lamp when said power supply voltage signal is less than said flash lamp self extinguishing voltage and at a time such that said flash lamp de-ionizes while said power supply voltage signal remains below said self extinguishing voltage; and repeating said charging and said firing steps.

2. The method of claim 1 further comprising the step of:

interrupting the current flow to said flash lamp before the voltage across said energy storage means falls below said flash lamp self extinguishing voltage.

3. A circuit for repetitively firing a flash lamp, said flash lamp having a self extinguishing voltage, said circuit comprising:

a means for storing energy having inputs for connection to a power supply having a periodic voltage signal, said means for storing energy connected across the electrodes of said flash lamp;

a means for triggering said flash lamp;

a means for detecting when the voltage of said periodic power supply signal falls below said flash lamp self extinguishing voltage;

said voltage detecting means operative to trigger said triggering means thereby firing said flash lamp when said periodic power supply voltage signal is below said flash lamp self extinguishing voltage.

4. The circuit of claim 3 wherein said means for storing energy is a capacitor.

5. The circuit of claim 4 wherein said means for detecting is a zero crossing detector.

6. The circuit of claim 3 further comprising a means for interrupting the current flow to said flash lamp before the voltage across said energy storage means falls below said flash lamp self extinguishing voltage.

7. The circuit of claim 6 wherein said interrupting means is a voltage comparator comparing the voltage across said energy storage means to a predetermined voltage level, and a bipolar MOSFET in series with said flash lamp, said bipolar MOSFET operatively connected to the output of said voltage comparator to turn off when said voltage across said energy storage means falls below said predetermined voltage level.

8. A method of repetitively firing a flash lamp, said flash lamp having a self extinguishing voltage in the range of 100 to 300 volts and a discharge time of 30 to 200 microseconds, said method comprising the steps of:

providing an AC power supply having a substantially 60 Hz sinusoidal voltage signal;

providing a means for storing energy, said energy storage means being connected across the electrodes of said flash lamp and across said power supply;

charging said energy storage means to substantially 2000 volts with said AC power supply;

firing said flash lamp when said power supply voltage signal is at substantially zero volts; and repeating said charging and said firing steps.

9. A method of providing pulsed energy, said method comprising the steps of:

providing a power supply having a periodic voltage signal;

providing a means for storing energy, said energy storage means being connected across said power supply, said energy storage means having outputs for connection to an electrical device;

charging said energy storage means with said power supply voltage signal;

discharging said energy storage means into said electrical device at a time when said power supply voltage signal is below a first predetermined value;

interrupting the current flow to said electrical device before the voltage across said energy storage means falls below a second predetermined value; and repeating said charging, discharging, and interrupting steps.

10. A circuit for providing pulsed energy, said circuit comprising:

a means for storing energy having inputs for connection to a power supply having a periodic voltage signal; output terminals;

a means for interrupting a connection, said interrupting means connected between said energy storage means and said output terminals;

a means for detecting when said periodic voltage signal falls below a first predetermined value;

a means for detecting when the voltage across said energy storage means falls below a second predetermined value, said second predetermined value being greater than said first predetermined value;

said first predetermined value detecting means operative to close said interrupting means when said periodic voltage signal is below said first predetermined value whereby said energy storage means is dischargably connected to said output terminals;

said second predetermined value detecting means operative to open said interrupting means when the voltage across the energy storage means falls below said second predetermined value whereby the discharge of said energy storage means is interrupted.

11. A circuit for repetitively firing a flash lamp, said flash lamp having a self extinguishing voltage, said circuit comprising:

an energy storage circuit having inputs for connection to a power supply having a periodic voltage signal, said energy storage circuit connected across the electrodes of said flash lamp;

a flash lamp triggering circuit operatively connected to trigger said flash lamp;

a voltage detection circuit operatively connected to said periodic power supply and said flash lamp triggering circuit;

said voltage detection circuit operative to trigger said triggering circuit thereby firing said flash lamp when said power supply periodic voltage signal falls below said flash lamp self extinguishing voltage.

12. The circuit of claim 11 further comprising a current interruption circuit operatively connected to said flash lamp, said current interruption circuit operative to interrupt current flow through said flash lamp before the voltage across said energy storage circuit falls below said flash lamp self extinguishing voltage.

13. The circuit of claim 12 wherein said current interruption circuit has a voltage comparator circuit comparing the voltage across said energy storage circuit to a predetermined voltage level, said predetermined voltage level being greater than said flash lamp self extinguishing voltage, wherein said current interruption circuit also has a bipolar MOSFET in series with said flash lamp, said bipolar MOSFET operatively connected to the output of said voltage comparator circuit to turn off when said voltage across said energy storage circuit falls below said predetermined voltage level.

* * * * *